US005088133A

United States Patent [19]

Chen

[11] Patent Number: 5,088,133

[45] Date of Patent: Feb. 18, 1992

[54] FLUSH MECHANISM FOR TOILETS

[76] Inventor: Tsai-An Chen, 201, Sec. 3, Ba-Dar Road, Taipei, Taiwan

[21] Appl. No.: 470,246

[22] Filed: Jan. 25, 1990

[51] Int. Cl.[5] ..... E03D 1/34

[52] U.S. Cl. ..... 4/390; 4/411; 4/412; 4/378; 4/379; 137/411; 137/433

[58] Field of Search ..... 4/366, 378, 411, 412, 4/390, 379; 137/431, 432, 411, 430, 433

[56] References Cited

U.S. PATENT DOCUMENTS

| | | | |
|---|---|---|---|
| 605,989 | 6/1898 | Bean | 4/412 |
| 2,223,509 | 12/1940 | Bralaer | 137/433 |
| 2,591,975 | 4/1952 | Southwick | 4/366 |
| 2,625,950 | 1/1953 | Clover | 137/433 |
| 3,982,556 | 9/1976 | Roosa | 4/366 X |
| 4,080,986 | 3/1978 | Schoepe | 137/432 |
| 4,318,194 | 3/1982 | Pinkston | 4/366 |
| 4,791,689 | 12/1988 | De Couto | 4/366 |

FOREIGN PATENT DOCUMENTS

| | | | |
|---|---|---|---|
| 51271 | 10/1966 | German Democratic Rep. | 4/411 |

*Primary Examiner*—Henry K. Artis

*Attorney, Agent, or Firm*—Morton J. Rosenberg; David I. Klein

[57] ABSTRACT

A flush mechanism for toilets comprises a water supply control device and a water escape control device independently disposed in a flush tank. The mechanism is actuated to flush by raising a plunger to lift a piston of the water escape position from its normally closed position to its open position allowing water flow from the tank to a toilet bowl associated therewith and maintain that position by vacuum suction.

3 Claims, 8 Drawing Sheets

FLUSH MECHANISM FOR TOILETS

BACKGROUND OF THE INVENTION

The present invention relates to new and useful improvements in flush mechanisms for the flush tanks of toilets.

A known flush mechanism for toilets generally comprises a flush tank having a water inlet pipe connected to the bottom thereof and also having an outlet pipe connected to the bottom thereof and leading to a toilet (not shown). The outlet pipe includes a flush valve 5 and communicates with a vertical overflow pipe 2. An arm extending outwardly through an upper portion of a side wall of the flush tank and rotatably secured thereto has a bent end portion normally pointing downwardly. Attached to the outer end of the arm is a handle 6 which can be pushed to rotate the bent end portion of the arm thus opening the flush valve for a water flush action to the toilet through a cord interconnecting the flush valve 5 and the leading end of the bent end portion of the arm. A water inlet pipe 1 upstanding from a portion of the bottom of the tank and communicating with the water supply pipe connected thereto and a water cut-off valve 4 for water inlet control is mounted on the top end of the water inlet pipe 1. Said water cut-off valve 4 is actuated by a float 3 to close the valve 4 in accordance with the level of water in the tank.

The known mechanism disclosed above is often found to be leaky and out of order mainly due to water corrosion to the metallic parts used therewith. Moreover, the toilets associated therewith are only water flushed and sanitary condition of the toilets after flushing is not satisfactory. To this end, the inventor has attempted to make an improved flush mechanism for toilets to overcome the drawbacks of prior art toilets mentioned above.

OBJECTS OF THE INVENTION

An object of this invention is to provide an improved flush mechanism for toilets which can diminish the disadvantages of known mechanisms.

It is another object of this invention to provide a flush mechanism with a construction that allows for a water clean treatment sequential to water flush a toilet associated therewith.

It is a further object of this invention to provide a flush mechanism of this character of simple construction which is efficient and reliable in operation and relatively inexpensive to manufacture.

BRIEF DISCRIPTION OF THE DRAWINGS

DETAILED DESCRIPTION OF THE PREFERRED EMBODIMENT

Figure 1:
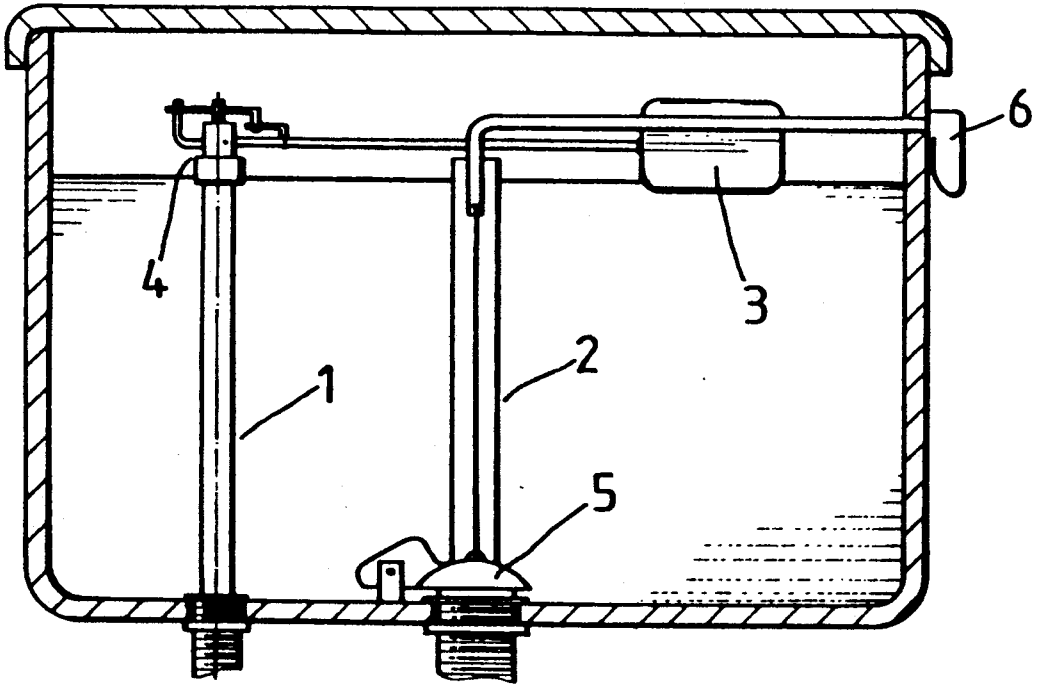
(PRIOR ART) Fig. 1
FIG. 1 is a cross-sectional view showing a known flush mechanism for toilets.
Figure 2:
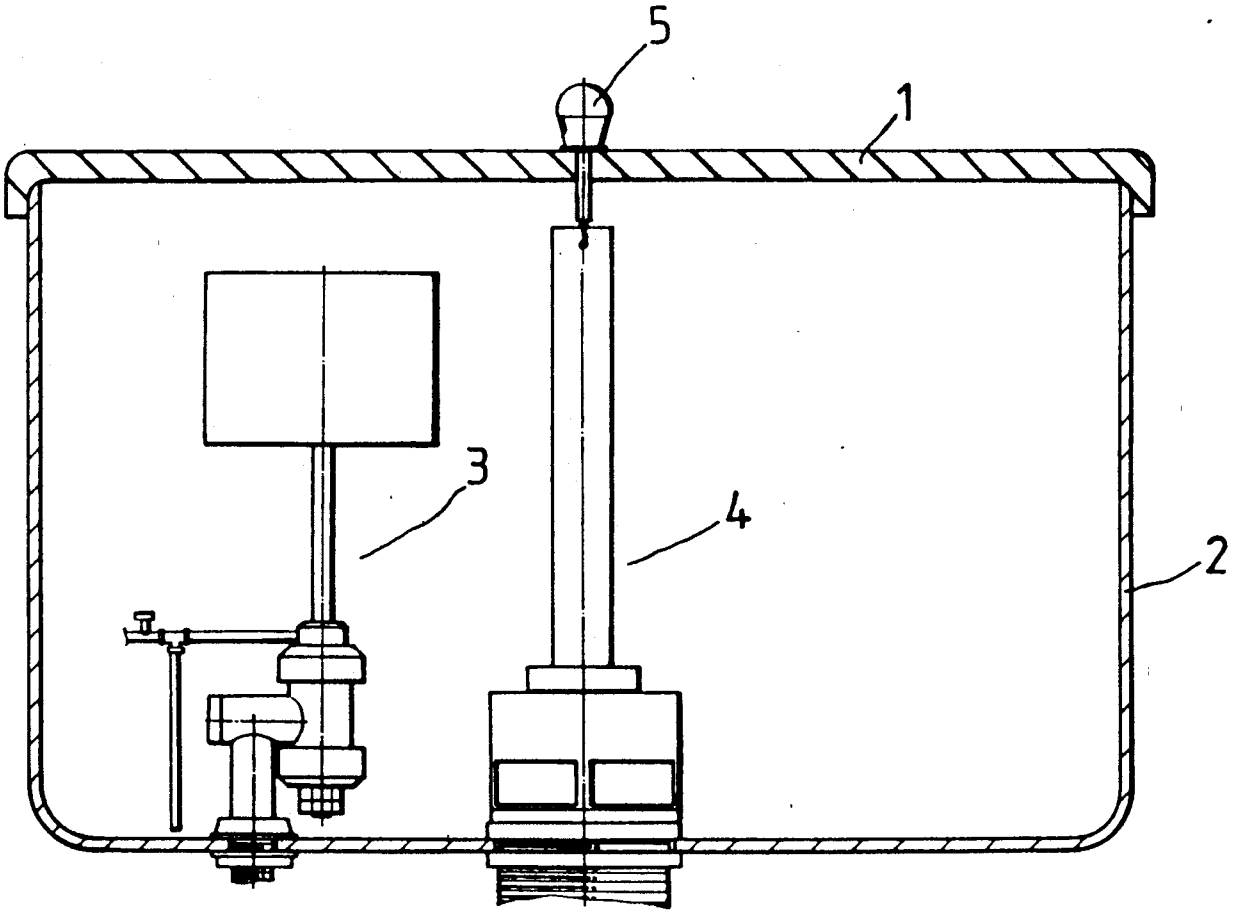
FIG. 2 is a cross-sectional view showing a preferred embodiment of this invention.

Referring now to FIG. 1, the flush mechanism for toilets of this invention comprises a flush tank 2 having an open top which is removably closed by a cover 1. A water supply device 3 and water escape valve 4 associated with a plunger 5 are separately disposed in the tank 2.

Figure 3:
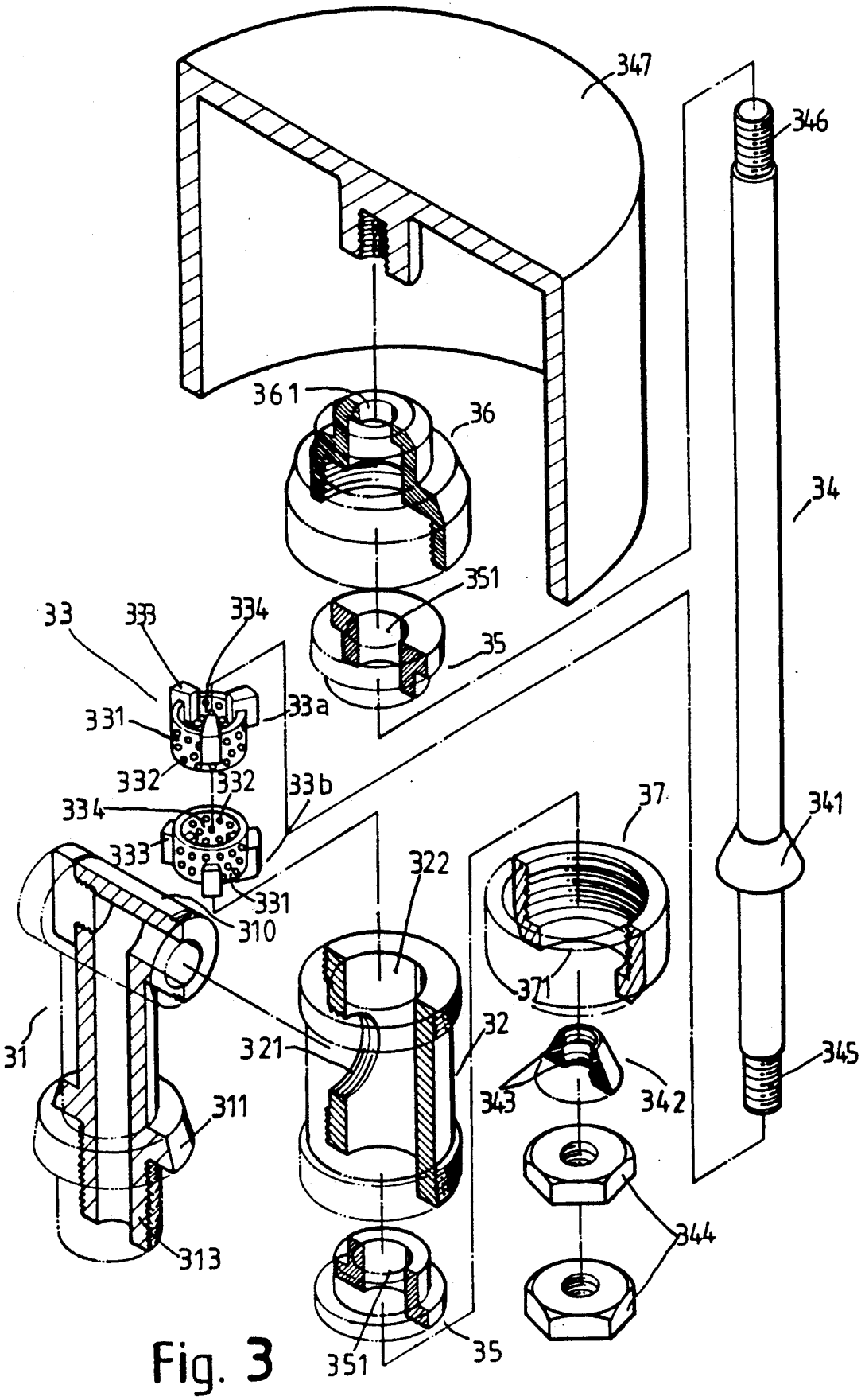
FIG. 3 is an exploded and fragmentary perspective view of the water supply device having a water cut-off valve used in this invention.
Figure 4:
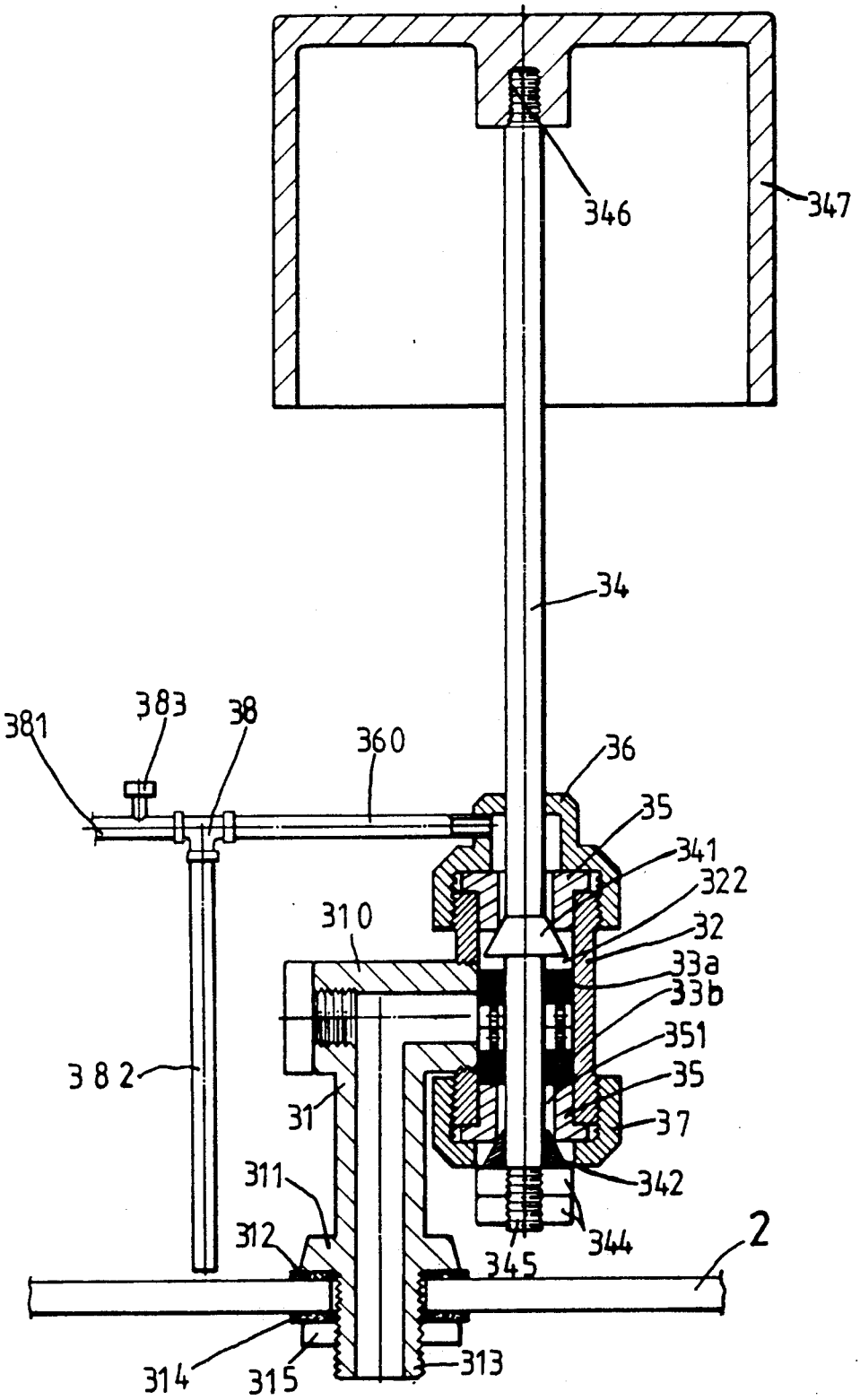
FIG. 4 is a cross-sectional view of the water supply device having water cut-off valves in an assembled and cut-off state.
Figure 5:
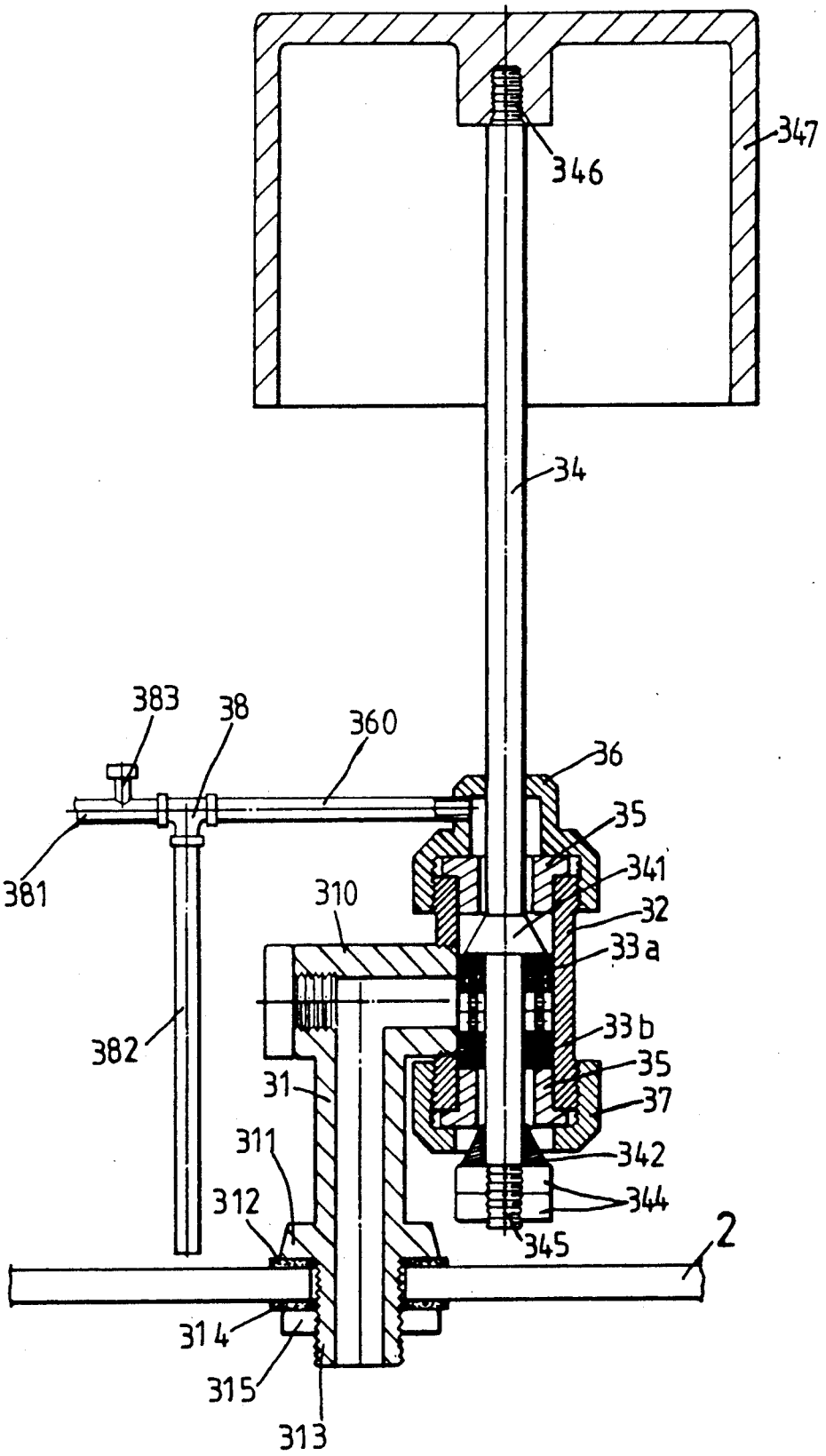
FIG. 5 is a similar view showing the valves in an open state.

Referring to FIGS. 3 to 5, the water supply device 3 has a substantially T-shaped water inlet member 31 defining a water passage turning aside in the head 310 thereof. The water inlet member 31 is formed with a flange 311 and a threaded section 313 extending downwardly from the flange 311. The water inlet member 31 is secured to the bottom of the tank 2 by inserting the threaded section 313 through an opening formed in the bottom 2 and tightly threaded with a nut 315 from under the bottom 2. An end portion of the threaded section 313 is left for connecting a water supply pipe (not shown) leading to a water source (not shown). The flange 311 and the nut 315 coact to sandwich a resilient seals 312, 314 therebetween to provide a liquid tight seal with the opening in the bottom of the flush tank 2.

A cylindrical member 32 is formed in a side wall thereof. An internal-threaded opening 321 is adapted to be threadedly engaged with an external-threaded end section of head portion 310 which is supported by the water inlet member 31 in a vertical extending state. Two external-threaded sections are formed on opposed ends of the cylindrical member 32 which defines a passage 322 which communicates with the passage in the water supply member 31 through the opening 321. A silencer 33 divided into an upper section **33*a* and a lower section 33*b*, each of which defines a passage 334 and is formed with a ring member 331. The ring member 331 is formed with a plurality of perforations 332 and three ribs 333 evenly mounted on the ring member 331 and extending inwardly to define the radii of a cylindrical passage, which is accommodated in the passage 322 of the cylindrical member 32. The object of the silencer 33 is to modify the head or force of the water entering the inner chamber of the cylindrical member 32**.

An upstanding rod 34 has two threaded ends 345, 346 and a first valve 341 sleeved thereon at a lower position. A portion below the first valve 341 of the rod 34 is slidably retained by the ribs 333 of the silencer 33 through the cylindrical passage thereof. Two resilient valve seats 35, each defining a central passage 351 and loosenly surrounding the rod 34 are press-fitted into the open ends of the cylindrical member 32 with flanges thereof abutting end perimeters of the cylindrical member 32. Two vessel-shaped retainers 36, 37 are positioned with openings 361, 371 respectively formed in the top wall and bottom wall thereof. The internal threads on the inner surfaces of the side walls thereof are secured to two ends of the cylindrical member 32 by means of threaded engagements therebetween, thus retaining the rod 34 and the retainers 36, 37 in position relatively to the cylindrical member 32. In said assembled state, the rod 34 extends upwardly through the opening 361 of the upper retainer 36 and downwardly through the opening 371 of the lower retainer 37. A second resilient valve 342 formed with a central passage which is integrally formed with two spaced seal rings 343 internally mounted for water tight mounting around the rod 34 and is sleeved on a lower portion neighboring the threaded section 345 and secured in position by two nuts 344 which coact to adjust the position of the second valve 342 relative to the first valve 341 to simultaneously close, respectively, the two valve seats 35 with the first and second valves 341, 342.

An intermediate pipe 360 has one end connecting to the upper retainer 36 and communicating with the inner chamber or passage of the cylindrical member 32 through the central passage 351 of the upper valve seat 35 and another end connecting to an inlet end of a three-ways joint 38 which has two outlet ends other than the inlet end. A first outlet pipe 382 opening into the tank 2 extends downwardly from one outlet end of the joint 38 so that its outlet is brought close to the bottom of the tank 2, and this provides for the flow of the water into the tank with little or no noise. A second outlet pipe 381 leads to an inlet end of a toilet cleaning system (not shown) comprising a conduit surrounding an upper inner surface of the toilet and a plurality of spray openings evenly formed in the conduit for spraying water downwardly along the inner surface of the toilet. The second outlet pipe 381 is provided with a control valve 383 in the pipe line thereof for closing the second outlet pipe 381 when necessary.

Attached to the upper end 346 of the valve rod 34 is a float 347 which is in the shape of an inverted cup open at its lower end, otherwise tight, and adapted to contain air.

Figure 6:
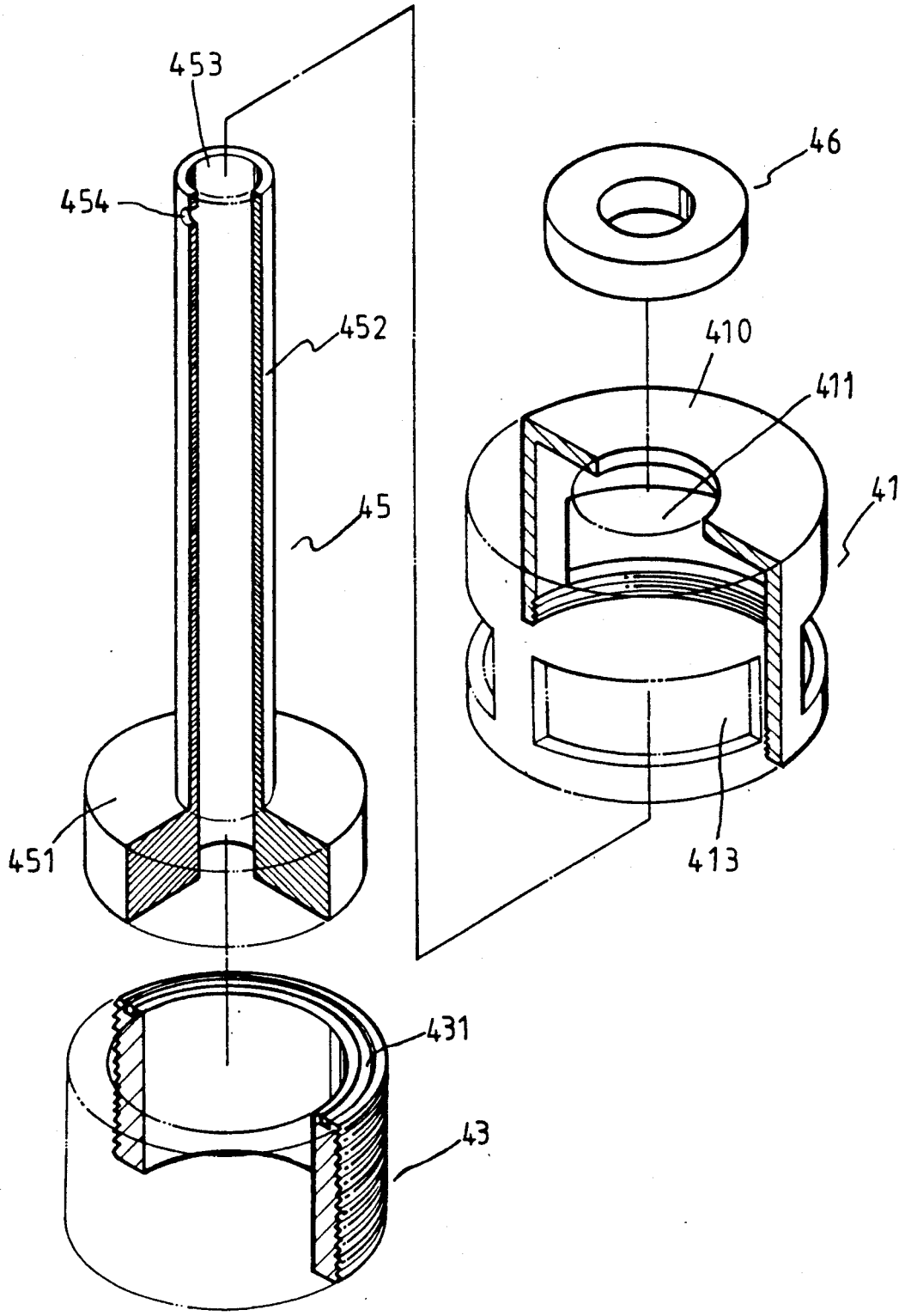
FIG. 6 is an exploded and fragmentary perspective view of the water escape valve used in this invention.
Figure 7:
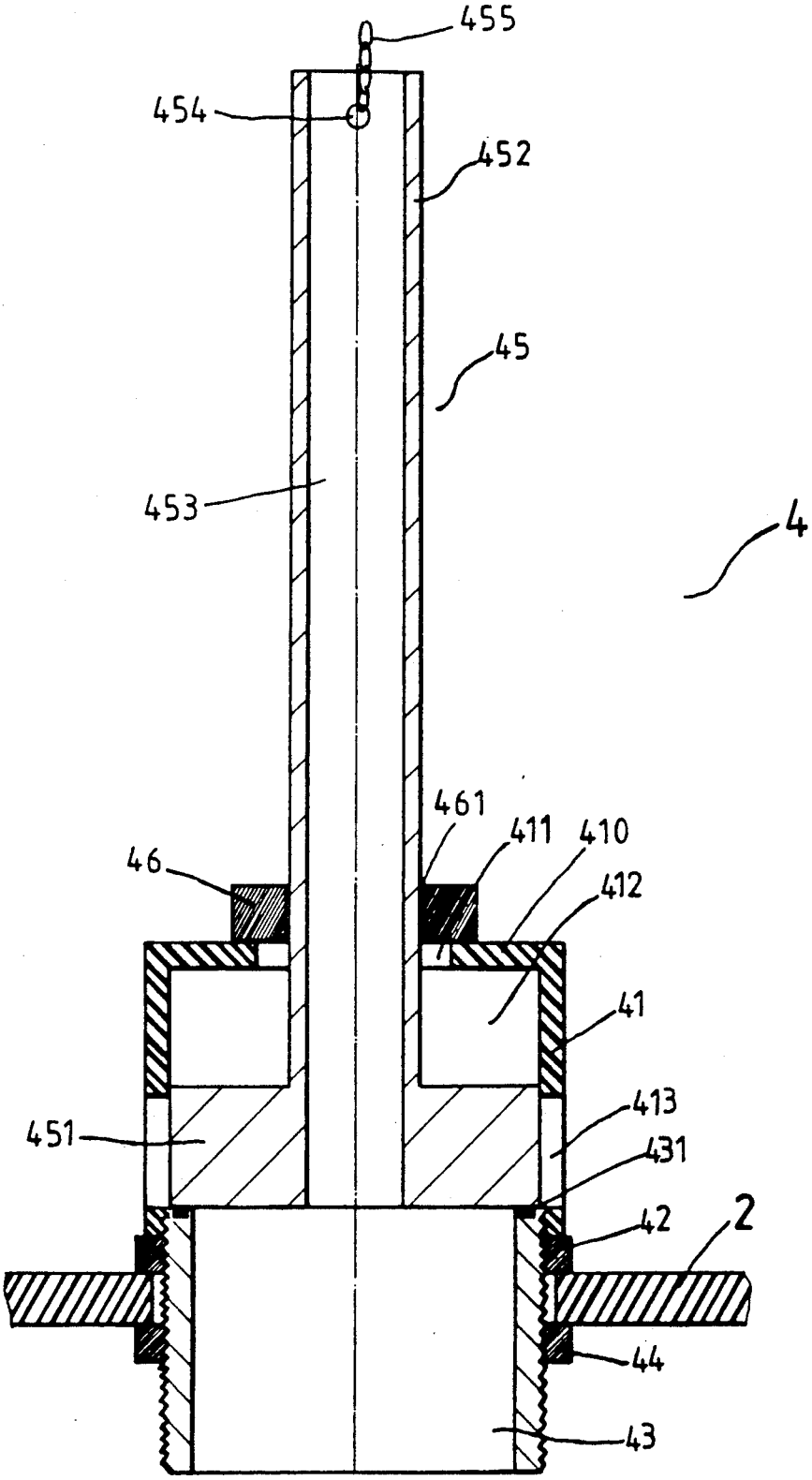
FIG. 7 is a cross-sectional view of the water escape valve in an assembled and closed state.
Figure 8:
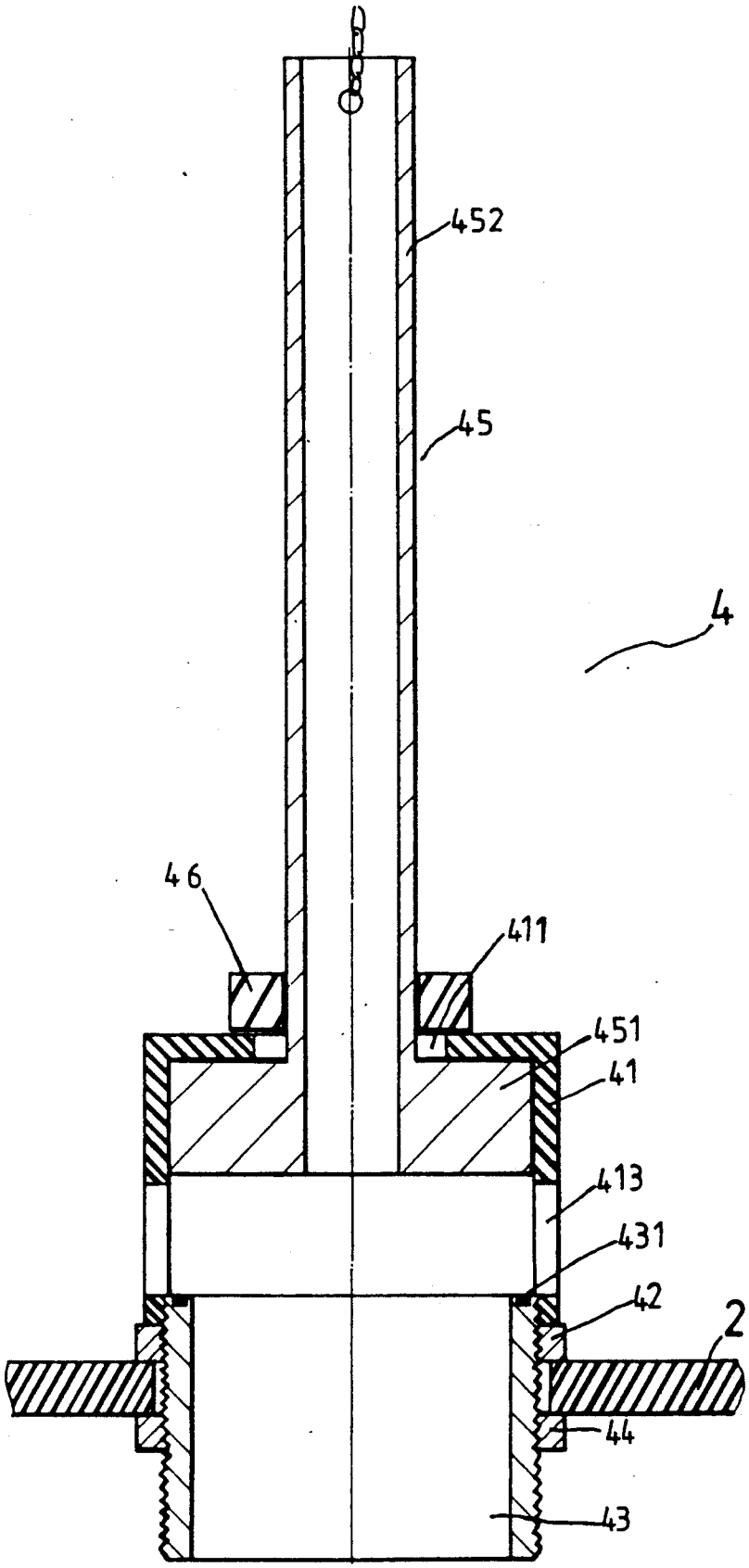
FIG. 8 is a similar view of the water escape valve in an open state.

Referring to FIGS. 6 to 8, the water escape valve 4 includes a guide cap 41 having an open bottom, a central opening 411 in the top plate 410 thereof, a series of side openings 413 in the lower portion of the cylindrical side wall and an internal threaded section in an inner surface of the cylindrical side wall below the openings 413. A piston unit 45 having a piston 451 integrally formed with an upstanding pipe 452 is provided to reciprocate in the guide cylinder 41. The piston 451 and the pipe 452 define a passage 453 therethrough such that the pipe 452 serves as an overflow pipe to drain water over the top end of the pipe 452. A joint 43 formed with external threads is secured to the bottom of the tank 2 by inserting the joint 43 through an opening in the bottom 2 and secured by means of adjusting nuts 42, 44, one nut 42 above the bottom and the other nut 44 below. An outlet pipe (not shown) leading to the toilet bowl can be communicatively connected to the outlet end of the joint 43 and the internal threaded section of the guide cap 41 can be threadedly connected to the inlet end of the joint 43. The piston 451 is sufficient in thickness slides downwardly to a lowermost position with its bottom resting on a circular perimeter of the top end, in which is grooved has inserted therein a seal ring 431, of the joint 43 whereas the piston 451 seals the side openings 413 of the guide cap 41 and the inlet end of the joint 43. Communication through the passage 453 is maintained with joint 43 as shown in FIG. 7. The piston rod or overflow pipe 452 extends upwardly through the opening 41 to a proper height and forms an opening 454 on the top end portion. The opening 454 of the overflow pipe 452 is tightened by one end of an interconnection chain or cord 455 of which the other end is connected to the plunger 5. A ring member 46 is slidably sleeved on the overflow pipe 452 and normally rest on the top plate 410 of the guide cap 41 wherein the dimension of the inner periphery of the ring member 46 is slightly larger than the outer periphery of the overflow pipe 452 thus forming a circular small gap 461 therebetween.

When the piston unit 45 is actuated to lift the overflow pipe 452 and the associated piston 451 which slide upwards relative to the cap 41, water in the chamber of the guide cap 41 above the piston 451 will be forced to flow upwardly and outwardly, thus forcing the ring member 46 to leave its normal position of closing the opening, thereby allowing 411 said water to be discharged from the cap 41 through the opening 411. Instantly, the ring member 46 drops to return to its normal position by gravity. When the piston unit 45 is released, it tends to drop, as the opening 411 is closed by the ring member 46 and the gap 461 is sealed by water, no air is allowed to get into space 412 between the cap 41 and the piston 451 thus forming a partial vacuum to suck and maintain the piston 451 in an upper position where the side openings 413 are left open. Flowing of water through the side openings 413 lowers the water level until below the top surface of the ring member 46 which allows air to get into the space 412 between the cap 41 and the piston 451 which breaks the vacuum therein and releases the piston 415 to drop by gravity.

In a flushing operation, the normal position of the parts of the mechanism is represented in FIGS. 4 and 7, both the water supply device 3 and water escape valve 4 are closed and the tank 2 is filled with water. The flush mechanism is actuated by lifting the plunger 5, the overflow pipe 452 is raised to lift the piston 451 to open the side openings 413 so that water in the flush tank 2 is drained to a toilet bowl. The lowering of the float 347 will open the valves 341, 342 of the water supply device 3 for an inlet pipe connected to the water inlet member 31 to replenish the supply in the tank 2. Water supplied through the passage of the water inlet member 31 and the silencer 33 will separate both ways downwardly through lower valve seat 35 into the tank 2 or upwardly through the upper valve seat 35 into the intermediate pipe 360. Said replenishing water is partially led to a cleaning system of the toilet bowl through the second outlet pipe 381. The water level in the tank 2 keeps lowering until it reaches a level below the top end of the ring member 46 which releases the piston 451 to drop to close the side openings 413 by which breaks the vacuum to the piston 451 as described above. When the float 347 rises to a predetermined level, the valves 341, 342 will be closed to cut off the inlet and cease supplying water to the cleaning system through the second outlet pipe 381.

While the invention has been described with respect to a preferred embodiment, it is obvious that various modifications can be made therein without departing from the spirit of the present invention which should be limited only by the scope of the claim.

What is claimed is:

1. A flush mechanism comprising a water supply control device and a water escape control device separately disposed in a flush tank and actuation means, said water supply control device including:

support means defining a passage therethrough and having a first end secured to a bottom of the flush tank with an intake end extending outwardly through the bottom for water inlet and a second end bent to extend horizontally within said flush tank;

a valve body member defining a passage extending vertically therethrough and communicating with the passage of the support means through an opening in a side wall of the valve body member and communicatively secured to the bent end of the support means;

valve seat members of resilient material fitted in opposed ends of the valve body member and defining respective passages normally intercommunicating the passage in said valve body member with the interior of said tank;

a rod member extending upwardly through the passage of the valve body to a predetermined height;

means in the passage of said valve body member for slidably retaining the rod member in position relative to said valve body member;

valve head members mounted on the rod member and adapted to be moved by the rod member synchronously between a first position closing the passages and a second position wherein the passages are open;

a float connected to said rod member for actuating the valve members to move between the first and second positions via the rod member;

means for securing the valve seat members in position in the valve body member;

said water escape control device including:

cylinder means having an open bottom, a top plate formed with an opening and a plurality of openings in a side wall thereof;

means for securing the cylinder member to the bottom of the tank;

piston means having a piston adapted to reciprocate in the cylinder means between a first position wherein the openings in the cylinder means are not sealed and a second position closing the openings, a pipe upstanding from the piston through the opening of the top plate of the cylinder member and defining a passage therebetween, and a passage extending through the pipe and the piston and downwardly communicating with the open bottom of the cylinder means; and said actuation means including a plunger and means interconnecting the plunger and the piston means for actuating the piston to move from its second position to its first position.

2. A flush mechanism as claimed in claim 1 wherein the water escape control device further comprises a ring member adapted to sleeve on the pipe of the piston means thus defining therebetween an air gap, said ring member being between a first position resting on the top plate of the cylinder member thus closing the passage between the pipe of the piston unit and the top plate while maintaining intercommunication between the air gap and the interior of said cylinder member and a second position wherein said passage is open.

3. A flush mechanism as claimed in claim 1 wherein the water supply control device further comprises one pipe open to a lower portion of the interior of the flush tank and another pipe communicating exterior of the flush tank and connected to an outlet end of one of said passages of one of the valve seat members.

* * * * *